United States Patent [19]

Sawada

[11] 3,977,185

[45] Aug. 31, 1976

[54] APPARATUS FOR GENERATING HIGH-TEMPERATURE AND HIGH-PRESSURE GAS

[75] Inventor: Ryosaku Sawada, Nishinomiya, Japan

[73] Assignee: Kabushiki Kaisha Hanshin Gijutsu Kenkyusho, Japan

[22] Filed: June 6, 1974

[21] Appl. No.: 476,877

[30] Foreign Application Priority Data

June 6, 1973 Japan ..... 48-64289

[52] U.S. Cl. ..... 60/39.55; 60/39.78

[51] Int. Cl.[2] ..... F02C 5/00; F02C 7/00

[58] Field of Search ..... 60/39.53, 39.55, 39.59, 60/39.78

[56] References Cited

UNITED STATES PATENTS

| | | | |
|---|---|---|---|
| 891,820 | 6/1908 | Croyt | 60/39.78 |
| 1,147,085 | 7/1915 | Gray | 60/39.55 |
| 2,357,041 | 8/1944 | Woolley | 60/39.53 |

FOREIGN PATENTS OR APPLICATIONS

| | | | |
|---|---|---|---|
| 26,224 | 11/1908 | United Kingdom | 60/39.53 |

*Primary Examiner*—Carlton R. Croyle
*Assistant Examiner*—L. J. Casaregola
*Attorney, Agent, or Firm*—Craig & Antonelli

[57] ABSTRACT

An apparatus for generating steam or like high-temperature and high-pressure gas for use in steam engines, steam turbines, internal combustion engines and heating systems. The apparatus comprises a combustion chamber, a rotor disposed within the combustion chamber in hermetical sliding contact with its peripheral wall and having a portion for receiving a fuel-air mixture to be ignited and combusted during the rotation of the rotor, and another chamber communicating with the combustion chamber to receive the combustion gas. The apparatus is very simple in construction and operates efficiently. Additional air and water can be brought into contact with the combustion gas in the second-mentioned chamber.

13 Claims, 12 Drawing Figures

APPARATUS FOR GENERATING HIGH-TEMPERATURE AND HIGH-PRESSURE GAS

BACKGROUND OF THE INVENTION

The present invention relates to an apparatus for generating a high-temperature and high-pressure gas, more particularly to an apparatus which is very simple in construction and operates efficiently to generate steam or like high-temperature and high-pressure gas for use in steam turbines, steam engines, internal combustion engines or heating systems.

Steam and other high-temperature and high-pressure gases are used as pressure sources and heat sources in steam turbines, steam engines, internal combustion engines and general heating system. Various apparatuses for generating such high-temperature and high-pressure gases have heretofore been provided, but they are complex in construction and are not fully adapted for smooth and trouble-free operation. Moreover, many of them are inefficient and have the drawback of being liable to produce pollutants, entailing atmospheric pollution problems.

SUMMARY OF THE INVENTION

According to the present invention a rotor, driven by a suitable drive for example, an an electric motor, is provided and disposed in a combustion chamber with the rotor having a fuel-air mixture receiving portion cooperating with at least one fuel-air intake port and a suitable ignition means whereby the rotor is driven to supply the hot combustion gases to an interior chamber communicating with the combustion chamber.

According to one feature of the present invention, the rotor may be provided with one or more portions for receiving at least one of air, water, catalyst or the like from a suitable intake port or ports communicating with the combustion chamber or an additional working chamber or chambers.

Where additional air is supplied, the air can be released with a suitable timing before or after the combusted fuel-air mixture reaches the interior chamber whereby even a fuel air mixture of high concentration can be combusted without permitting carbon monoxide and hydrocarbons to be left over.

Moreover, according to the present invention, the volume of the fuel-air mixture to be ignited can be reduced to greatly reduce the nitrogen oxides to be generated at a high temperature thereby promoting perfect combustion and preventing the emission of pollutants. Consequently, the present invention is capable of generating high temperature and high pressure gas with a high thermal efficiency and free of pollution.

When water or alcohol is conjointly used and supplied to the rotor of the present invention, steam pressure becomes available or the hydrogen and oxygen resulting from the decomposition of water can be utilized for recombustion.

According to a further feature of the present invention, a apparatus, not of the external combustion type is provided which effectively utilizes the high temperature and high pressure gas in an efficient and economical manner since the escape of heat, for example, from a flue is precluded.

According to a further feature of the present invention, the interior chamber receiving the high-temperature and high pressure gas from the fuel-air mixture portion of the rotor is provided with one or more suitable working chambers each of which accommodates therein a rotor in hermetical sliding contact with the peripheral wall of the respective working chamber as in the combustion chamber. Each rotor may be separately driven by a conventional drive means, for example, an electric motor, with a suitable conventional gearing arrangement or the like or a conventional motor control arrangement being provided to assure a proper synchronization between the rotation of the rotor in the combustion chamber and the individual rotors in the respective working chamber.

According to a further feature of the present invention a single drive means such as an electric motor may be employed to drive each of the rotors in synchronism with an appropriate conventional motor control system being employed to selectively control the motor speed and rotation of the rotors.

While additional air, water, catalyst or the like can be supplied to the combustion chamber, according to further embodiments of the present invention, additional air or the like can also be supplied to a respective working chamber or chambers by a suitable intake port or ports with the rotor disposed in the respective working chamber being provided with an appropriate air or receiving portion. The respective rotors disposed in the working chamber are driven by a suitable conventional drive means, for example, one or more electric motors and upon the air or the like receiving portion coming in contact with the high temperature combustion gas in the interior chamber, a pollution free, high temperature and high pressure gas is generated which comprises the combustion gas and the additional air or, if water is supplied, a steam is generated resulting from the contact of the combustion gas with the supplied water.

One advantage of supplying additional air, water and the like to the working chamber independently of the combustion chamber resides in the fact that the additional air, water and the like can be supplied in amounts variable with the amount of combustion gas from the combustion chamber.

Accordingly, it is an object of the present invention to provide an apparatus for generating high temperature and high pressure gas which avoids the drawbacks and shortcomings encountered in the prior art which is very simple in construction and efficient to operate without the emission of pollutants.

A further object of the present invention resides in providing an apparatus for generating a high temperature and high pressure gas comprising a combustion chamber and a cylindrical rotor accommodated in the combustion chamber in sliding contact with its peripheral wall so that the rotary element is smoothly operable and free of trouble.

Another object of the present invention is to provide an apparatus for generating a high-temperature and high-pressure gas comprising a combustion chamber and a rotor disposed in the chamber in sliding contact with its peripheral wall, the rotor having a recessed receiving portion in its circumferential surface so as to be rotatable while hermetically retaining a fuel-air mixture in the receiving portion.

Another object of the present invention is to provide an apparatus for generating a high-temperature and high-pressure gas including a rotor which is rotatable to serve as a kind of valve, thereby eliminating the necessity to use complex valve means.

Still another object of the present invention is to provide an apparatus for generating a high-temperature and high-pressure gas including a combustion chamber and another chamber communicating therewith in which additional air and/or water can be brought into contact with the combustion gas from the combustion chamber.

A further object of the present invention is to provide an arrangement for producing a useful high-temperature and high-pressure gas easily with a simple construction. peripheral to the receiving virture by the drive rotation of the 20, These and other objects, features and advantages of the present invention will become more apparent from the following description when taken in connection with the accompanying drawings which show, for the purpose of illustration only, several embodiments in accordance with the present invention.

DESCRIPTION OF THE PREFERRED EMBODIMENTS

Figure 1:
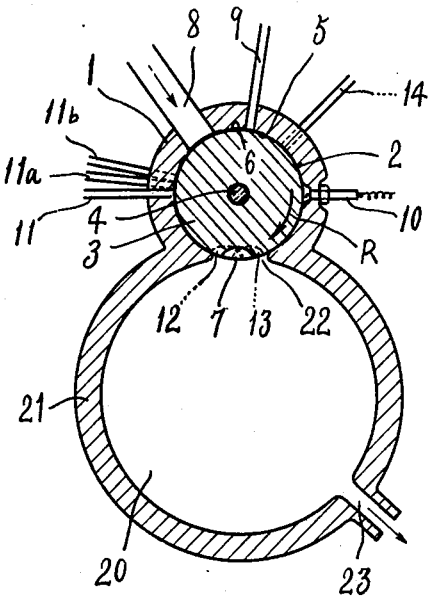
FIG. 1 is a view in vertical section showing a first embodiment of the apparatus of the present invention.

Referring now to the drawing wherein like reference numerals are used throughout the various views to designate like parts and more particularly to FIG. 1 which shows a casing 1, a combustion chamber 2 within the casing 1, a rotor 3 of the horizontal cylindrical type and the center shaft 4 of the rotor 3. The circumferential surface 6 of the rotor 3 is in hermetical sliding contact with the peripheral wall 5 of the combustion chamber 2. The rotor 3 has a fuel-air mixture receiving portion 7 in the shape of a cavity formed in its circumferential surface 6. An air intake port 8 and fuel intake port 9 serve as inlets for materials to form the fuel-air mixture. Reference numeral 10 indicates an ignition port and reference numeral 11 designates an exhaust port. These ports 10 and 11 are formed in the peripheral wall 5 and arranged along the path of movement of the fuel-air mixture receiving portion 7. The distance between the air intake port 8 and the ignition 10, and the distance between the fuel intake port 9 and the ignition port 10 are greater than the dimension of the portion 7 in the circumferential direction of the rotor 3.

Figure 2:
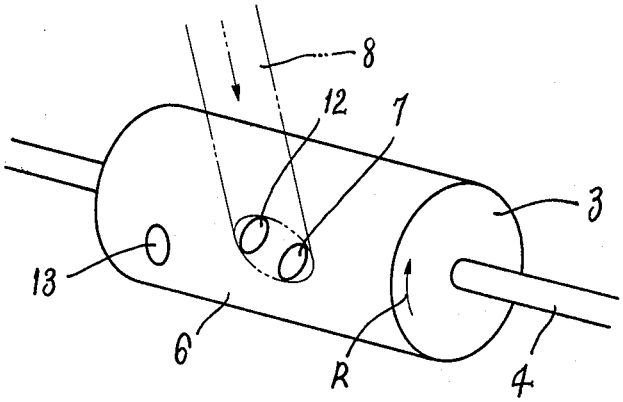
FIG. 2 is a perspective view of a rotor according to the present invention.

As shown in FIG. 2, the circumferential surface 6 of the rotor 3 is formed, in proximity to the receiving portion 7, with another portion 12 for receiving additional air supply which is adapted to communicate with the air intake port 8. Another portion 13 for receiving water is also formed in the circumferential surface independent of the portions 7 and 12.

As shown in FIG. 1, at a portion of the peripheral wall 5 corresponding to the path of movement of the additional air receiving portion 12, there is provided an exhaust port 11*a*, while a water supply port 14 and an exhaust port 11*b* are positioned at other portions of the peripheral wall 5 corresponding to the path of movement of the water receiving portion 13.

Integral with the casing 1 is a casing 21 having an interior chamber 20 communicating with the combustion chamber 2 through an opening 22 so as to communicate with the fuel-air mixture receiving portion 7, additional air receiving portion 12 and water receiving portion 13 and to receive a high-temperature and high-pressure gas. The chamber 20 is provided with an outlet 23 for sending out the high-temperature, high-pressure gas to a turbine or some other place of use.

The embodiment of FIGS. 1 and 2 operates as described below. The rotor 3 is rotated in the direction of the arrow R in FIG. 1 by a suitable drive means, for example, a conventional electric motor (not shown), and brings the fuel-air mixture receiving portion 7 into registry with the air intake port 8 in the pripheral wall 5 and then with the fuel intake port 9, whereby air and fuel are supplied to receiving portion 7 to form a fuel-air mixture. Thus, the fuel-air mixture fills the receivzng portion 7 in compressed state. Additional air is supplied to the air receiving portion 12 also from the air intake port 8. By virtue of further rotation of the rotor 3 by means (not shown), the receiving portion 7 reaches the ignition port 10, whereupon the fuel-air mixture is ignited and combusted into a combustion gas of high-temperature and high-pressure. The continued rotarion of rotor 3 results in the receiving portion 7 reaching the communicating opening 22 and releasing the combustion gas into the chamber 20. In the course of return movement of the portion 7 toward the air intake port 8, return combustion gas or remaining gas in the portion 7, if any, is run off from the intermediate exhaust port 11, making the portion 7 ready for the subsequent air intake operation. When the receiving portion 7 returns to the intake port 8, one cycle is completed. Thus, the combustion gas resulting from the ignition of the fuel-air mixture in the receiving portion 7 works to repeat this cycle.

During the above-mentioned bove-mentioned one cycle, air is taken into the additional air receiving portion 12 in the rotor 3 as already described, so that further rotation of the rotor 3 releases the air into the chamber 20 through the communicating opening 22 between the combustion chamber 2 and the chamber 20. Accordingly, fresh air can be supplied to the chamber 20 with the desired timing before or after the high-temperature and high-pressure combustion gas is introduced into the chamber 20. Whether the additional air is supplied to the chamber 20 before or after the introduction of the combustion gas thereto depends on whether the additional air receiving portion 12 is positioned to the front or to the rear of the receiving portion 7 with respect to the direction of rotation of the rotor 3. To prolong the duration of supply of the additional air, the portion 12 may be elongated circumferentially of the rotor 3. The gas admitted into the air receiving portion 12 from the communicating opening 22 is drawn off through the exhaust port 11*a*, thereby making the air receiving portion 12 ready for the subsequent air intake from the air intake port 8.

The water supplied to the water receiving portion 13 in the rotor 3 from the water supply port 14 during the foregoing cycle is released into the chamber 20 through the communicating opening 22 by virtue of the rotation of the rotor 3 to come into contact with the high temperature combustion gas, whereupon steam is generated. The gas admitted into the portion 13 from the opening 22 is exhausted from the port 11*b* to make the water receiving portion 13 ready for the subsequent supply of water from water intake port 14.

The high-temperature, high-pressure gas thus produced in the chamber 20 is sent out from the outlet 23 of the chamber 20 to a steam turbine or steam engine or is used for a wide variety of applications as, for example, heating.

Figure 3:
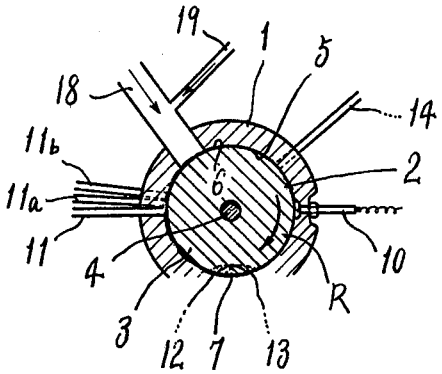
FIG. 3 is a fragmentary view in vertical section showing another embodiment of the present invention including a modified fuel-air mixture intake port.

Although the air intake port 8 and fuel intake port 9 are separately provided in the embodiment illustrated in FIGS. 1 and 2 as inlets for the materials to form a fuel-air mixture, the embodiment shown in FIG. 3 is of a different construction in that a fuel port 19 is not formed in the peripheral wall 5 of the combustion chamber 2 but is joined with an air intake port 18 so that a compressed fuel-air mixture can be supplied from the intake port 18.

Figure 4:
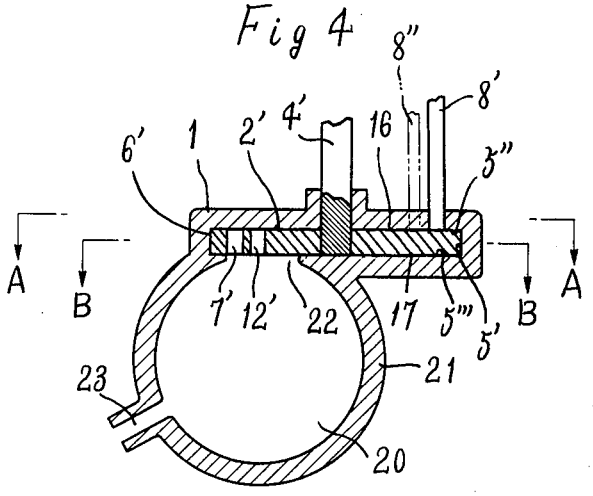
FIG. 4 is a cross-sectional view showing a further embodiment of the present invention including modified combustion chamber and rotor.
Figure 5:
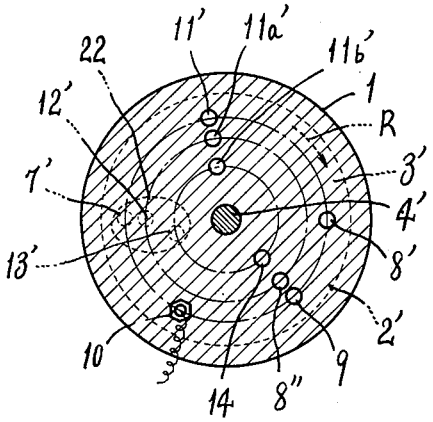
FIGS. 5 and 6 are cross-sectional views taken along the line A—A and the line B—B in FIG. 4 respectively.
Figure 6:
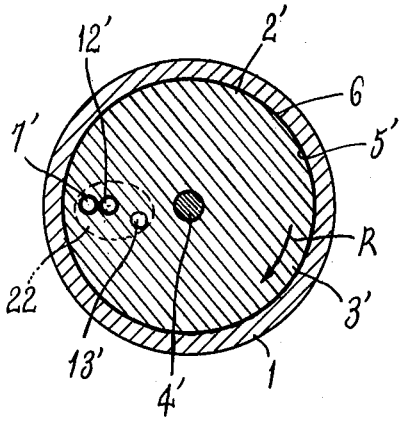

Furthermore, although the rotor 3 in the embodiment of FIGS. 1–3 is cylindrical, the rotor 3 of the embodiment shown in FIGS. 4–6 is in the form of a disc having a vertically extending center shaft 4'. The circumferential surface 6' of the rotor 3' and upper and lower surfaces 16 and 17 are in sliding contact with the peripheral wall 5' and upper and lower walls 5'' and 5''' of a combustion chamber 2', respectively. A fuel-air mixture receiving portion 7', a portion 12' for receiving an additional air supply and a water receiving portion 13' all extend through the disc-shaped rotor 3'. The fuel-air mixture receiving portion 7' is adapted to communicate with an intake port 8', then with a fuel intake port 9' and thereafter with an ignition port 10', these ports being formed in the upper wall 5'' of the combustion chamber 2'. The additional air receiving portion 12' is adapted to communicate with another air intake port 8'', and the receiving portion 13'' with a water supply port 14'. All of these receiving portions communicate with a chamber 20 when brought to the position of an opening 22. After gas has been drawn off from exhaust ports 11', 11*a* and 11*b'* the same cycle as in the embodiments of FIGS. 1–3 will be repeated.

Figure 11:
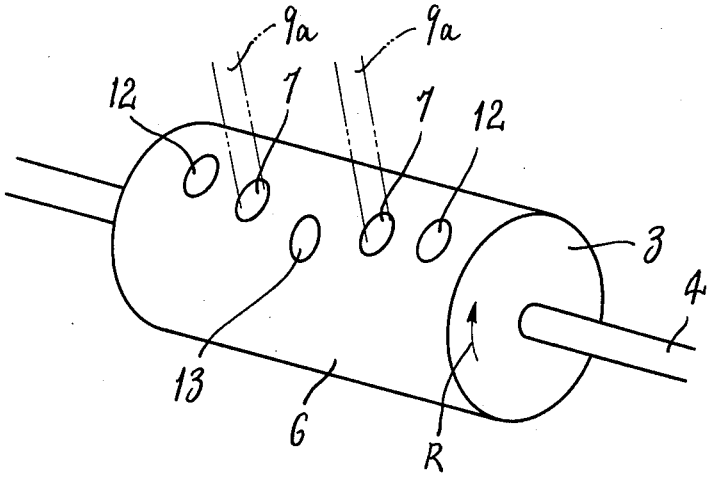
FIGS. 11–12 are perspective views showing modified rotors according to the present invention.
Figure 12:
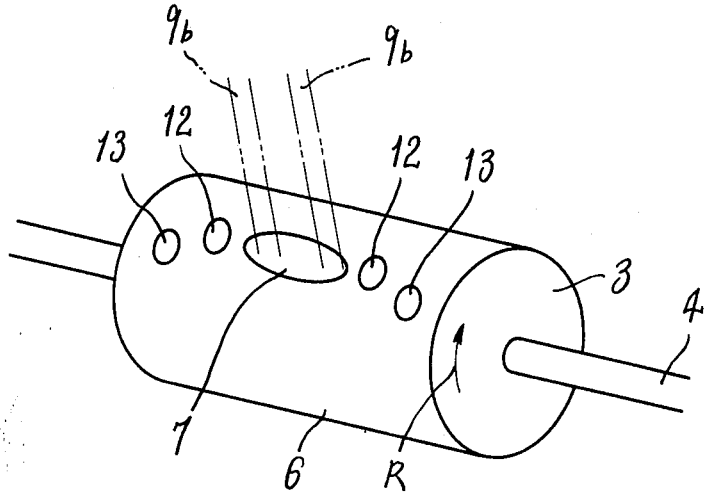

According to the present invention, the fuel-air mixture receiving portion 7 may be so shaped as to facilitate release of the high-pressure combustion gas but to prevent return of the gas, in which case the exhaust port 11 can be eliminated. If the center shaft 4 of the rotor 3 has a hollow construction for receiving water or air, the rotor 3 can be cooled with ease. In the case where the air intake port 8 and fuel intake port 9 are provided separately for supplying the materials, the rotor 3 may have at least two fuel-air mixture receiving portions 7 adapted to communicate with fuel intake ports 9*a* (indicated in dot-and-dash lines) respectively as seen in FIG. 11, or one receiving portion 7 may be adapted to communicate with at least two fuel intake ports 9*b* as shown in FIG. 12. With this latter construction fuel is injected alternately from the two ports, whereby the interval of fuel injection through each of the fuel intake ports 9*a* or 9*b* can be at least doubled. This latter arrangement also serves to eliminate the possible delay of fuel injection when the rotor is driven at a high speed thereby assuring fuel injection with accurate timing all the time and can be employed, whether the rotor is cylindrical or disc-like configuration.

According to the present invention, as shown if FIGS. 7–10, a suitable number of working chambers can be provided for the chamber for receiving the high-temperature and high-pressure gas from the fuel-air mixture receiving portion 7.

Figure 7:
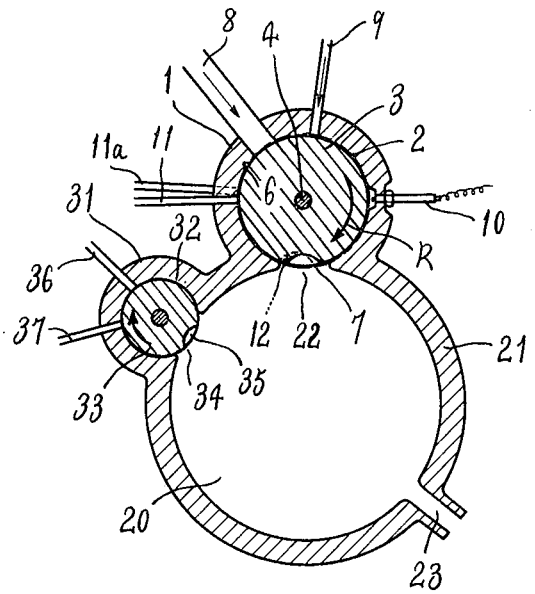
FIGS. 7–10 are cross-sectional views showing further embodiments of the present invention in which a chamber attached to a combustion chamber is provided with at least one working chamber.

As shown in FIG. 7, a casing 31 is integrally formed with the casing 12 having the chamber 20 and has an interior working chamber 32 communicating with the chamber 20 through an opening 34. As in the combustion chamber 2, the chamber 32 accommodates a rotor 33 in hermetical sliding contact with its peripheral wall. The rotor 33 has a water receiving portion 35, for which a water supply port 36 and exhaust port 37 are formed in the casing 31. As to rotor 33 is dirven by suitable conventional drive means (not shown), the water receiving portion 35 cyclically reaches the opening 34 and water is released into the chamber 20 and brought into contact with the high temperature combustion gas. The high-temperature and high-pressure gas resulting from contact between the water and combustion gas generates steam which is sent out from the outlet 23 of the chamber 20 to a place where it is utilized. When the water supply chamber 32 is attached to the chamber 20, the rotor 3 for fuel-air mixture need not be provided with the water receiving portion 13.

Figure 8:
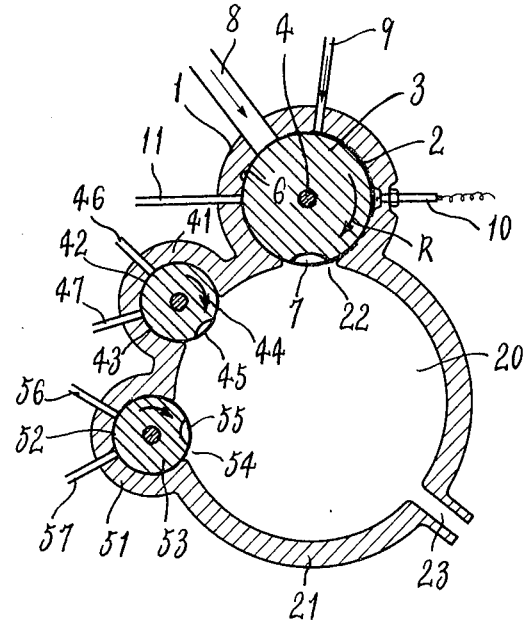

Although the rotor 33 may be provided with a plurality of receiving portions, FIG. 8 shows a further embodiment of the present invention wherein two casing 41 and 51 integral with the casing 21 of the chamber 20 have interior working chambers 42, 52 communicating with the chamber 20 through openings 44, 54 respectively. The working chamber 42 closer to the combustion chamber 2 serves to supply additional air and the other working chamber 52 remote therefrom serves to supply water. The chambers 42, 52 a accommodate rotors 43, 53 driven by synchronized individual drive motors (not shown) or a single drive motor (not shown) interconnecting the rotors by a conventional transmission means. The rotors 43, 53 are formed with suitable air and water receiving portions 45, 55 respectively, and are provided with air and water supply ports 46, 56 respectively, and exhaust ports 47, 57. In this embodiment, the rotor 3 for fuel-air mixture need not be provided with the additional air receiving portion 12 and water receiving portion 31.

Figure 9:
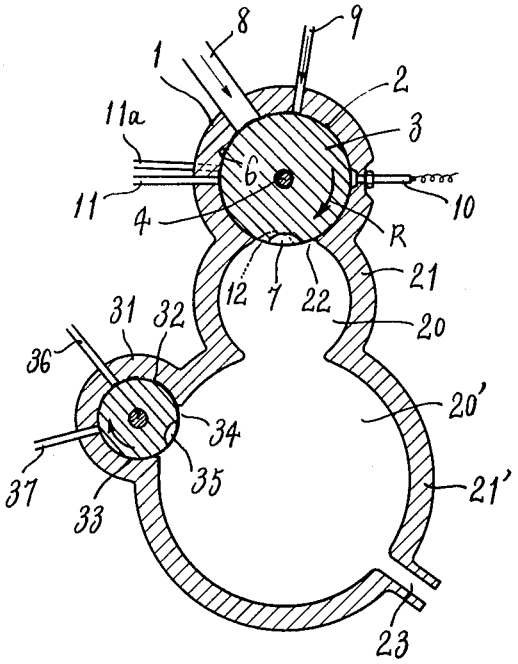
Figure 10:
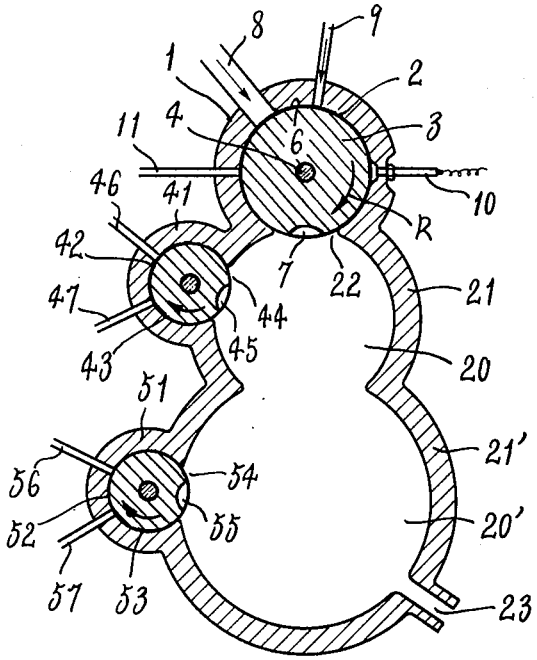

Alternatively, as shown in FIGS. 9 and 10, the chamber for receiving combustion gas from the fuel-air mixture receiving portion 7 may comprise two compartments 20 and 20' defined by casing 21 and 21' and communicating with each other as seen in FIGS. 9 and 10. The compartments 20 and 20' are provided with a suitable number of working chambers.

According to the embodiment of FIG. 9, the compartment 20' remote from the combustion chamber 2, is provided with a working chamber 32 in which is accommodated the rotor 33 in hermetically sealing contact with the peripheral wall of the chamber.

In the embodiment of FIG. 10, a working chamber 42 provided for the compartment 20 serves to supply air, while a working chamber 52 for the compartment 20' serves to supply water.

Both of the embodiments illustrated in FIGS. 9 and 10 achieve good results and with these embodiments, the high-temperature and high-pressure gas is sent out from the remote compartment 20' through an outlet 23 to a suitable place of use.

According to the construction of the present invention, the rotor 3 for fuel-air mixture is in sliding contact with the peripheral wall of the combustion chamber 2, and since the rotor 3 is circular and the combustion chamber 2 is shaped in conformity therewith, smooth rotation free of objections is assured. Furthermore, the fuel-air mixture receiving portion 7 is adapted to come into register with the intake ports 8 and 9 for forming a fuel-air mixture or the fuel-air mixture intake port 18, at the position of sliding contact between the rotor 3 and the combustion chamber 2, making certain that the rotor 3 will hermetically retain the fuel-air mixture during rotation. Inasmuch as the fuel-air mixture receiving portion 7, formed in a part of the rotor 3 is opened only when communicating with the intake ports but is otherwise closed by virtue of the sliding contact of the rotor 3 with the peripheral wall 5 or with the upper and lower walls 5', 5'' (FIG. 4), the rotating rotor 3 itself functions as a kind of valve, thereby eliminating the need to employ complex valve means and serving to simplify the overall construction.

When the chamber 20 for receiving the high-temperature and high-pressure gas has attained a sufficiently high temperature to permit ignition in the vicinity of the communicating opening 22, the ignition port 10 may function only at the initial stage for electrical ignition. The fuel-air mixture will thereafter be ignited upon contact with the high-temperature portion of the chamber. Usable as the ignition means for the ignition port 10 are heat accumulating material, piezoelectric element and various other suitable ignition means.

While I have shown and described several embodiments in accordance with the present invention, it is understood cavity the same is not limited thereto but is susceptible to numerous modifications and changes as known to those skilled in the art and I therefore do not wish to be limited to the details shown and described herein but intend to cover all such changes and modifications as are encompassed by the scope of the appended claims.

What I claim is:

1. An arrangement for generating a high temperature and a high pressure gas, the arrangement comprising: a casing, a combustion chamber means provided in said casing, means for supplying a fuel-air mixture to said combustion chamber means, means for supplying water to said combustion chamber means, a rotor means rotatably mounted in said combustion chamber means in hermetical sliding contact with a peripheral wall of said combustion chamber means, means for driving said rotor means, a first cavity formed in a circumferential surface of said rotor means for receiving the fuel-air mixture, means for igniting said fuel-air mixture received in said first cavity to form a high-temperature and high-pressure combustion gas, means communicating with said combustion chamber means for receiving said high-temperature and high-pressure combustion gas from said first cavity, a second cavity formed on a circumferential surface of said rotor means spaced from said first cavity in the direction of rotation of said rotor means for exclusively receiving an additional supply of air, means provided in said combustion chamber means for exhausting combustion gas from said second cavity, means for supplying water to said combustion chamber means, a third cavity formed on a circumferential surface of said rotor means spaced from said first and second cavities in the direction of rotation of said rotor means for exclusively receiving the water supplied to said combustion chamber means, and means provided in said combustion chamber means for exhausting combustion gases from said third cavity.

2. An arrangement according to claim 1, wherein said means for supplying said fuel-air mixture includes an air intake port and a fuel intake port formed in the peripheral wall of said combustion chamber means.

3. An arrangement according to claim 1, wherein said rotor means is substantially cylindrical.

4. An arrangement according to claim 1, wherein said second cavity is disposed on said circumferential surface behind said fuel-air mixture cavity in the direction of rotation of said rotor means.

5. An arrangement according to claim 1, wherein said second cavity is disposed on said circumferential surface preceding said fuel-air cavity in the direction of rotation of said rotor means.

6. An arrangement for generating a high temperature and a high pressure gas, the arrangement comprising: a casing, a combustion chamber means provided in said casing, means for supplying a fuel-air mixture to said combustion chamber means, a rotor means rotatably disposed in said combustion chamber means in hermetical sliding contact with a peripheral wall of said combustion chamber means, means for driving said rotor means, means provided in said rotor means for receiving said fuel-air mixture, means for igniting said fuel-air mixture received in said receiving means to form a high-temperature and high-pressure combustion gas, means communicating with said combustion chamber means for receiving said high-temperature and high-pressure combustion gas from said receiving means, said means for supplying said fuel-air mixture includes an air intake port and a fuel intake port formed in the peripheral wall of said combustion chamber means, said rotor means is substantially cylindrical and said receiving means is provided in the circumferential surface thereof, said receiving means includes a cavity formed in said circumferential surface, said rotor means is provided with means for receiving an additional supply of air from said air intake port, means are provided in said combustion chamber means for exhausting combustion gas from said means for receiving an additional supply of air, said means for receiving an additional supply of air includes a further cavity provided on said circumferential surface spaced from said cavity for receiving said fuel-air mixture, means for supplying water to said combustion chamber means, said rotor means further includes means for receiving said water supplied to said combustion chamber means, and means in said combustion chamber means for exhausting the combustion gas from said water receiving means, said means for receiving said water includes another cavity provided on said circumferential surface spaced from said fuel-air cavity and said air receiving cavity.

7. An arrangement according to claim 6, wherein said water cavity is disposed on said circumferential surface behind said fuel-air cavity in the direction of rotation of said rotor means.

8. An arrangement according to claim 1, wherein said means for supplying a fuel-air mixture includes a single port formed in the peripheral wall of said combustion chamber means.

9. An arrangement for generating a high-temperature and high-pressure gas, the arrangement comprising: a casing, a combustion chamber means provided in said casing, means for supplying a fuel-air mixture to said combustion chamber means, a rotor means rotatably disposed in said combustion chamber means in hermetical sliding contact with a peripheral wall of said combustion chamber means, means for driving said rotor means, means provided in said rotor means for receiving said fuel-air mixture, means including a first cavity for igniting said fuel-air mixture received in said receiving means to form a high-temperature and high-pressure combustion gas, means communicating with said combustion chamber means for receiving said high-temperature and high-pressure combustion gas from said receiving means, said means for supplying a fuel-air mixture includes an air intake port provided in the peripheral wall portion of said combustion chamber means, means for supplying water to said combustion chamber means, said rotor means including means for receiving said water and means for receiving additional air from said air intake port, said combustion chamber means being provided with means for exhausting the combustion gas from said water receiving means and said additional air receiving means, said means for receiving water includes a second cavity provided in the surface of said rotor means, said means for receiving said additional air including a third cavity provided on the surface of said rotor means spaced from said first cavity in the direction of rotation of said rotor means.

10. An arrangement according to claim 1, wherein said rotor means is substantially disc shaped, said first cavvity extends through said disc shaped rotor means.

11. An arrangement according to claim 10, wherein said means for supplying fuel-air mixture includes an air intake port.

12. An arrangement according to claim 11, wherein said second cavity extends through said disc-shaped rotor means.

13. An arrangement according to claim 12, wherein said third cavity extends through said disc-shaped rotor means.

* * * * *